United States Patent [19]

Kohlstette

[11] Patent Number: 4,781,670

[45] Date of Patent: Nov. 1, 1988

[54] CENTRIFUGE DRUM

[75] Inventor: Werner Kohlstette, Oelde, Fed. Rep. of Germany

[73] Assignee: Westfalia Separator AG, Oelde, Fed. Rep. of Germany

[21] Appl. No.: 62,282

[22] Filed: Jun. 12, 1987

[30] Foreign Application Priority Data

Jun. 24, 1986 [DE] Fed. Rep. of Germany ..... 3621074

[51] Int. Cl.[4] ..... B04B 1/14; B04B 11/00

[52] U.S. Cl. ..... 494/27; 494/48

[58] Field of Search ..... 494/2, 27, 38–40, 494/42, 48, 56; 210/360.1, 781, 782; 422/72

[56] References Cited

U.S. PATENT DOCUMENTS

| | | | |
|---|---|---|---|
| 4,077,564 | 3/1978 | Thylefors | 494/40 X |
| 4,103,822 | 8/1978 | Stroucken | 494/40 X |
| 4,151,951 | 5/1979 | Kohlstette | 494/40 X |
| 4,498,897 | 2/1985 | Gunnewig | 494/27 |
| 4,510,052 | 4/1985 | Eklof | 494/27 X |
| 4,514,183 | 4/1985 | Kohlstette | 494/27 |
| 4,645,485 | 2/1987 | Niemerg | 484/27 |
| 4,670,005 | 6/1987 | Kohlstette et al. | 494/27 X |

*Primary Examiner*—Philip R. Coe
*Assistant Examiner*—Stephen F. Gerrity
*Attorney, Agent, or Firm*—Sprung Horn Kramer & Woods

[57] ABSTRACT

A centrifuge drum has a chamber that can accommodate fluid formed by a concentric component inserted into the drum. The concentric component has a sealing ring accommodated in an annular groove at its outer diameter. The base of the annular groove can be supplied with control medium through a channel and emptied again through an outlet device. When the channel is full, the sealing ring is forced against a cylindrical surface and seals off an annular gap. When the channel is empty, the pressure of the fluid in the chamber forces the sealing ring in, releasing the annular gap for the chamber to empty through. In addition to acting as a seal, the sealing ring also acts as a valve, and allows a very simple design for all types of centrifuge-drum chambers that must be filled and emptied again during operation.

7 Claims, 2 Drawing Sheets

CENTRIFUGE DRUM

BACKGROUND OF THE INVENTION

The present invention relates to a centrifuge drum, especially a self-emptying centrifuge drum, with at least one chamber that accommodates a fluid and that is demarcated by a concentric component inserted into the drum with an annular groove located at the outer diameter and accommodating a sealing ring that seals off the chamber in that it rests against a cylindrical surface in the drum.

Centrifuge drums of this type are generally known and are manufactured in an extremely wide range of embodiments. The chamber that is sealed off by the sealing ring can accommodate either the centrifugate or a portion thereof or the control fluid. It is often necessary to empty this chamber periodically and refill it. The chamber in known drums is emptied through valves in the drum that can be activated from outside. The faster the chamber has to be emptied, the more expensive, usually, the valves.

U.S. Pat. No. 4,670,005 describes a self-emptying centrifuge drum wherein the closure fluid, which is located below a piston slide, is let out through an outlet channel in the form of an annular gap that can be closed off by a hydraulically powered valve body. Solutions of this type are complicated in design and cost-intensive.

SUMMARY OF THE INVENTION

The object of the present invention is to create a centrifuge drum wherein the channel can be rapidly emptied and that is simple in design and cost-effective.

This object is attained in accordance with the invention by the improvement wherein the base of the annular groove communicates, through at least one channel that extends radially inward, with a device for supplying control medium and wherein an outlet device is provided and through which the control medium is to be let out of the channel.

The sealing ring, which seals off the chamber in a known way, accordingly itself acts as a valve in that its sealing action is briefly discontinued, leaving an extensive outlet cross-section in the form of the annular gap between the two components that demarcate the chamber. The sealing ring is simultaneously allowed to stretch radially over its total circumference due to its generally inherent elasticity. The forces involved are the radially inward force of the fluid in the chamber, which supplies pressure in the form of a wedge of fluid between the sealing ring and the cylindrical surface that it rests against when sealing, and the radially outward force of the control medium acting on the base of the annular groove. The radially outward force prevails when the channel that communicates with the base of the groove is charged with fluid, and the radially inward force prevails when the channel is empty.

If compressed gas is employed as a control medium, the radial motion of the sealing ring can be obtained in a simple way whereby the channel communicates, through a line that can be blocked off, with a compressed-gas container outside the drum and the outlet device extends from that line.

The radial motion of the sealing ring can be obtained with a liquid control medium if the channel communicates with a gutter that accommodates a liquid control medium and the outlet device is positioned in an outlet channel through which the channel can be emptied.

The outlet device can be a constricted channel. In this case the sealing capacity of the sealing ring must be ensured by constantly supplying more control medium than leaves through the constricted channel. The supply of control medium must be interrupted in order to empty the channel.

To decrease the consumption of control medium; the outlet device can be a fluid-controlled centrifugal-force valve.

A reliable seal on the part of the ring against the sides of the annular groove is a prerequisite for the ring's function. This can be ensured for example if the annular groove is deep enough to ensure that the sealing ring will be forced against its sides.

It will be an advantage if the outer edges of the sealing ring are rounded off to facilitate the application of force by the fluid in the chamber.

Some preferred embodiments of the invention will now be specified with reference to the attached drawings, wherein

DETAILED DESCRIPTION OF THE PREFERRED EMBODIMENTS

Figure 1:
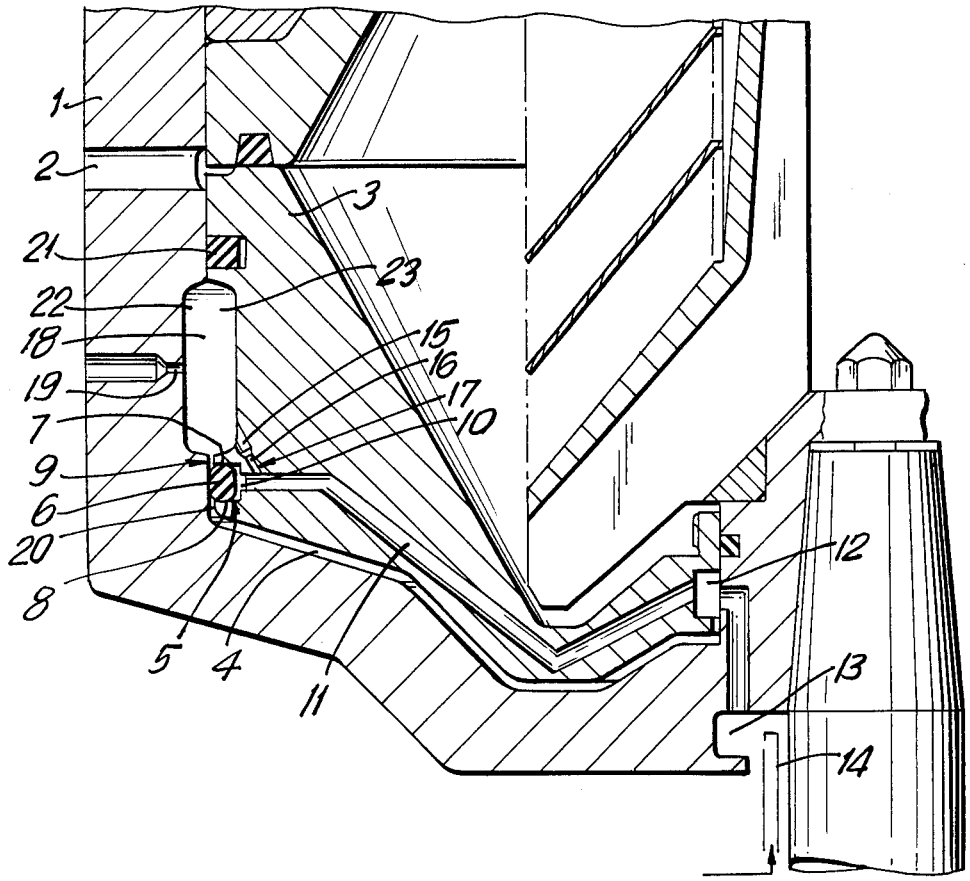
FIG. 1 is a detail of a section through a drum employed with a liquid control medium that is let out through a constricted channel in accordance with the invention.

A centrifuge drum 1 has extraction openings 2 that are closed off with a piston slide 3 when a chamber 4 is full. Piston slide 3 has an annular groove 5 at its outer diameter. A sealing ring 6 can move radially in groove 5. Sealing ring 6 rests tight against the sides 7 and 8 of annular groove 5 and seals off chamber 4 when it rests against a cylindrical surface 9 of the drum. A channel 11 leads from the base 10 of annular groove 5 to a gutter 12. Control medium can be supplied to gutter 12 through another gutter 13 from a device 14. First gutter 12 communicates at its inner diameter with chamber 4. An outlet channel 15 with an outlet device 17 in the form of a constriction 16 extends from the radially outer section of channel 11 to a reservoir 18. Reservoir 18 has a constricted outlet 19 and communicates with chamber 4 through an annular gap 20 in the vicinity of sealing ring 6 and between the outer diameter of piston slide 3 and the cylindrical surface 9 of the drum. Annular gap 20 can be closed off by sealing ring 6. Reservoir 18 is demarcated by a continuous recess 22 in drum 1 and another continuous recess 23 in piston slide 3 and is located between sealing ring 6 and another sealing ring 21.

When first gutter 12 is supplied with control medium, channel 11 will become full up to the level of the gutter and force sealing ring 6 tight against cylindrical surface 9. Chamber 4 will fill as soon as gutter 12 overflows, and the resulting pressure in the chamber will force piston slide 3 into its closure position. To empty the drum the supply of control medium to second gutter 13 is interrupted, and channel 11 will empty through outlet channel 15 and constriction 16. Sealing ring 6 will move radially inward subject to the pressure in chamber 4 and release annular gap 20, so that the contents of chamber 4 can empty rapidly into reservoir 18. If reservoir 18 is large enough to accommodate all the liquid in chamber 4, drum 1 will empty completely. If, on the other hand, reservoir 18 can accommodate only some of the liquid from chamber 4, the emptying will be only partial. Restoring the supply of control medium to second gutter 13 will force piston slide 3 back into its closure position. Reservoir 18 will then empty through constricted outlet 19.

Figure 2:
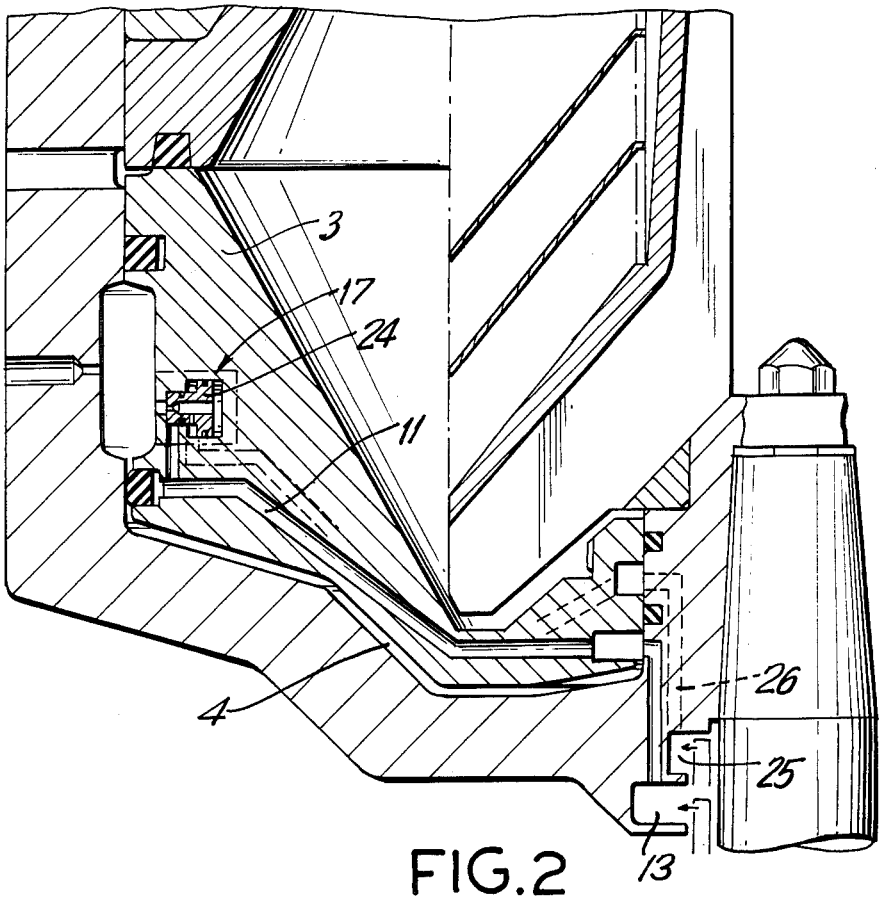
FIG. 2 is a detail of a section through an outlet device with a centrifugal-force valve according to the invention.

The embodiment illustrated in FIG. 2 does not require a constant supply of control medium to maintain piston slide 3 in the closure position, which is on the other hand attained in that the outlet device 17 is a liquid-controlled centrifugal-force valve 24 that is opened in order to empty channel 11 by briefly supplying control medium through a gutter 25 and a channel 26. Piston slide 3 moves down once chamber 4 is empty, and is then moved back into its closure position by supplying control medium to gutter 13.

Figure 3:
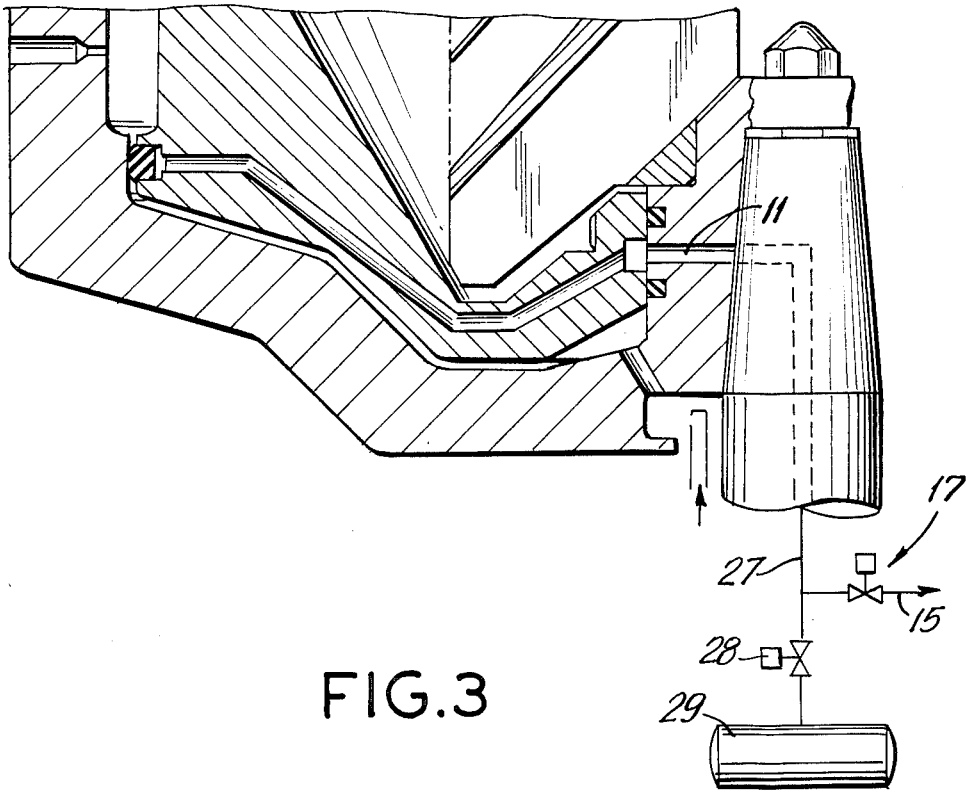
FIG. 3 is a detail of a section through a drum employed with a gaseous control medium according to the invention.

If gas is employed as a control fluid, the embodiment illustrated in FIG. 3 is employed, with outlet device 17 outside of the drum. Channel 11 communicates with a compressed-gas container 29 through a line 27 and a shut-off valve 28. An outlet channel 15 with an outlet device 17 extends from line 27 to the atmosphere. Piston slide 3 is closed by opening shut-off valve 28 to compress sealing ring 6 and then supplying liquid control medium to chamber 4 through gutter 13. Closing shut-off valve 28 and opening outlet device 17 simultaneously will release the gas pressure against the base 10 of annular groove 5, allowing sealing ring 6 to move radially in, whereby the emptying process is carried out as previously described herein.

It will be appreciated that the instant specification and claims are set forth by way of illustration and not limitation, and that various modifications and changes may be made without departing from the spirit and scope of the present invention.

What is claimed is:

1. In a self-emptying centrifuge drum, with at least one chamber that accommodates a control fluid and that is demarcated by a concentric component inserted into the drum and has an annular groove located at an outer diameter thereof and a sealing ring in the annular groove and configured to rest against a cylindrical surface in the drum to seal off the chamber, the improvement wherein the sealing ring is elastic and wherein the annular groove has an annular base and wherein the groove is configured to permit radial movement of the sealing ring to radially move towards and away from the annular base, at least one channel extending radially inwardly from the base and in fluid communication with the annular groove, means for supplying control medium to the channel to radially move the sealing ring away from the annular groove and seal off the chamber and means for effecting the outlet of the control medium from the channel to radially move the sealing ring towrads the annular groove and open the seal of said chamber.

2. The drum as in claim 1, further comprising a compressed-gas container outside the drum, a line providing communication between the channel and the container, means for blocking off the line and wherein the outlet means branches from the line.

3. The drum as in claim 1, further comprising a gutter that accommodates a liquid control medium and communicates with the channel and an outlet channel through which the channel can be emptied and wherein the outlet means is disposed in the outlet channel.

4. The drum as in claim 3, wherein the outlet means is a constricted channel.

5. The drum as in claim 3, wherein the outlet means is a fluid-controlled centrifugal-force valve.

6. The drum as in claim 1, wherein the annular groove is sufficiently deep to ensure that the sealing ring will be forced against sides walls thereof.

7. The drum as in claim 1, wherein the radially outer edges of the sealing ring are rounded.

* * * * *